US006789918B2

(12) United States Patent
Poon

(10) Patent No.: US 6,789,918 B2
(45) Date of Patent: Sep. 14, 2004

(54) HAND-HELD FLASHLIGHT APPLICABLE FOR ILLUMINATION OF LONG DISTANCE AND 360-DEGREE SECTOR

(75) Inventor: Tit Wing Poon, Shatin, N. T. (CN)

(73) Assignee: Flying Dragon Development Ltd., Shatin (CN)

( * ) Notice: Subject to any disclaimer, the term of this patent is extended or adjusted under 35 U.S.C. 154(b) by 0 days.

(21) Appl. No.: 10/337,491

(22) Filed: Jan. 7, 2003

(65) Prior Publication Data

US 2004/0057232 A1 Mar. 25, 2004

(30) Foreign Application Priority Data

Sep. 23, 2002 (CN) ..... 02254419 U

(51) Int. Cl.[7] ..... F21L 4/04

(52) U.S. Cl. ..... 362/188; 362/188; 362/197; 362/198; 362/288

(58) Field of Search ..... 362/288, 188, 362/197, 198, 202, 96

(56) References Cited

U.S. PATENT DOCUMENTS

| | | | | |
|---|---|---|---|---|
| 4,609,976 A | | 9/1986 | Geissler | 362/202 |
| 5,001,612 A | | 3/1991 | Odium | 362/187 |
| 5,530,633 A | | 6/1996 | Yuen | 362/184 |
| 5,535,107 A | * | 7/1996 | Prok | 362/158 |
| 6,045,237 A | * | 4/2000 | Parsons et al. | 362/205 |

FOREIGN PATENT DOCUMENTS

| | | |
|---|---|---|
| CN | 87 2 06191 U | 3/1988 |
| CN | 2112057 U | 8/1992 |
| CN | 2260231 Y | 8/1997 |
| CN | 1182852 A | 5/1998 |
| CN | 2366679 Y | 3/2000 |
| GB | 2 242 732 A | 9/1991 |
| WO | WO 94/28347 | 8/1994 |
| WO | WO 99/67567 | 12/1999 |

OTHER PUBLICATIONS

Chinese Search Report (2 pages) HK 02156.

* cited by examiner

*Primary Examiner*—Alan Cariaso
*Assistant Examiner*—Guiyoung Lee
(74) *Attorney, Agent, or Firm*—Alix, Yale & Ristas, LLP

(57) ABSTRACT

The present invention generally relates to a hand-held flashlight that is telescopically extendable along a concentric axis. The flashlight having a transparent portion which allows light to radiate out of the flashlight in a 360-degree sector when in the extended configuration. The flashlight having an exhaust unit for equalizing pressure between an interior and exterior of the flashlight.

9 Claims, 6 Drawing Sheets

HAND-HELD FLASHLIGHT APPLICABLE FOR ILLUMINATION OF LONG DISTANCE AND 360-DEGREE SECTOR

BACKGROUND OF THE INVENTION

The present invention relates to hand-held flashlights.

Conventional hand-held flashlights are designed mainly for structural improvement for transportation of the flashlight, neglecting innovations for other functions. For instance, Patent No. 87206191 disclosed a multiple-purpose flashlight that only has modified the structure of existing hand-held flashlights to be more convenient to carry about, freeing both hands. However, this flashlight only offers an on-off function and long distance light focusing by virtue of a reflecting cup and transparent cover. It cannot provide illumination of short distance in a 360-degree sector and other functions, such as needed for distress signals.

SUMMARY OF THE INVENTION

The present invention is generally directed to solving the problems of existing hand-held flashlights, which only offer an on-off function and long distance focusing illumination.

A hand-held flashlight in accordance with the present invention may be applicable for illumination of both long distance and unfocused lateral light dispersion through among other things a telescoping movement of a transparent portion of the flashlight from the body of the flashlight.

The flashlight in a preferred embodiment may have a head with a head-case, a transparent cover and a reflecting cup along with a transparent cylinder on a rear end of the head, the cylinder being tightly yet sliding coupled with the body. The transparent cylinder may operate in sliding cooperation with the body of the flashlight along a concentric axial center. The flashlight may have battery cells, a cell holder, and an end cap.

The body of flashlight may include a body-case that is a fluid tight coupling with the transparent cylinder and has fluid tight joints with bottom cap. Between the lamp cartridge and cell holder, there may be an electrical connection means between the lamp and cells and a means to provide an on-off function.

The bottom cap may be fitted tight with the body-case, and there may be an attachment of cell holder inside the bottom cap that is used for connection of the positive pole and negative pole of the cells.

There may be a through hole in said head-case or in the bottom cap or elsewhere on the flashlight, where an exhaust unit can be fitted and sealed that can regulate air pressure generated inside the flashlight due telescoping movement such stretching out and drawing back flashlight components.

The exhaust unit can be located anywhere on the flashlight and may be on the head-case where it comprises a knob fitted inside a through hole for air permeation, a cone spring, a copper pad and E-shaped pad, for retention of the spring and to maintain a spring tension. A rubber ring for sealing may be provided between the inner wall of through hole and permeation knob, or the exhaust unit can be arranged on the bottom cap and comprises a plug that fits into said through hole through a rib plate. An attached piece is provided between said plug and the wall of through hole that can move inside the through hole. And seal ring is placed between said attached piece and the wall of through hole.

There may be some lugs on the outer wall of said lamp cartridge corresponding to some lugs on the inner wall of the transparent cylinder allowing them to rotate together. The flashlight may have at least three working modes such as an ON, FLASH, and OFF mode.

The telescoping action of the hand-held flashlight illumination may allow for a focused illumination in one position or configuration and a dispersed lateral or 360-degree sector illumination in another configuration. The transparent cylinder may slidable with relation to the body allowing a stretching and pushing back between the flashlight body and the head. The air pressure generated due to stretching and pushing may be regulated by virtue of exhaust unit.

Illumination of a 360-degree sector of hand-held flashlight can be realized with the use of transparent cylinder.

The flashlight may have multiple operation modes of lighting by virtue of the design of ON, FLASH and OFF contacts in the circuit board to meet different demands of users.

BRIEF DESCRIPTION OF THE DRAWINGS

Other objects and advantages of the invention will be evident to one of ordinary skill in the art from the following detailed description may with reference to the accompanying drawings, in which.

DETAILED DESCRIPTION OF A PREFERRED EMBODIMENT

Figure 1:
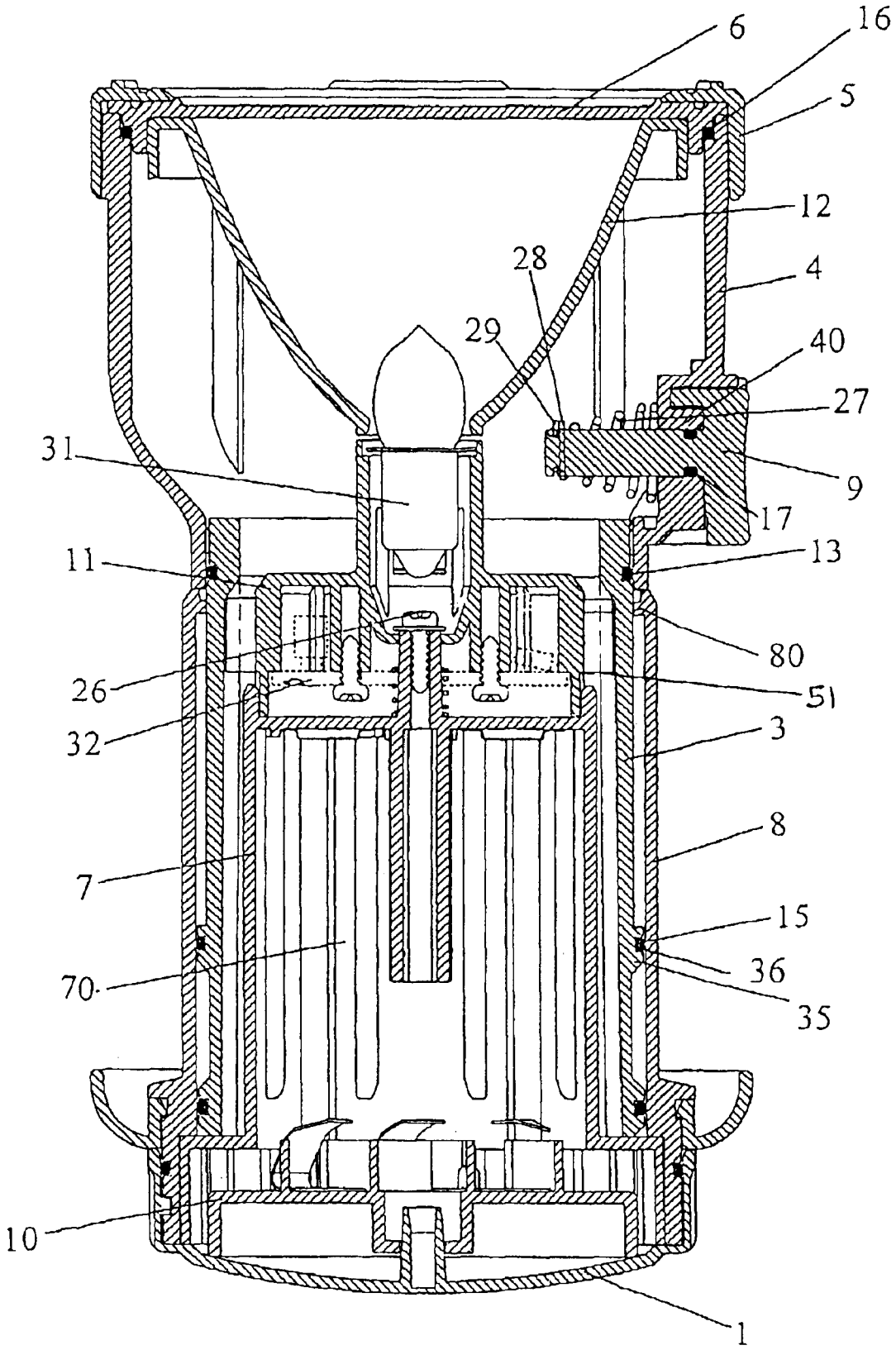
FIG. 1 is the sectional schematic diagram of the hand-held flashlight in accordance with the present invention.
Figure 2:
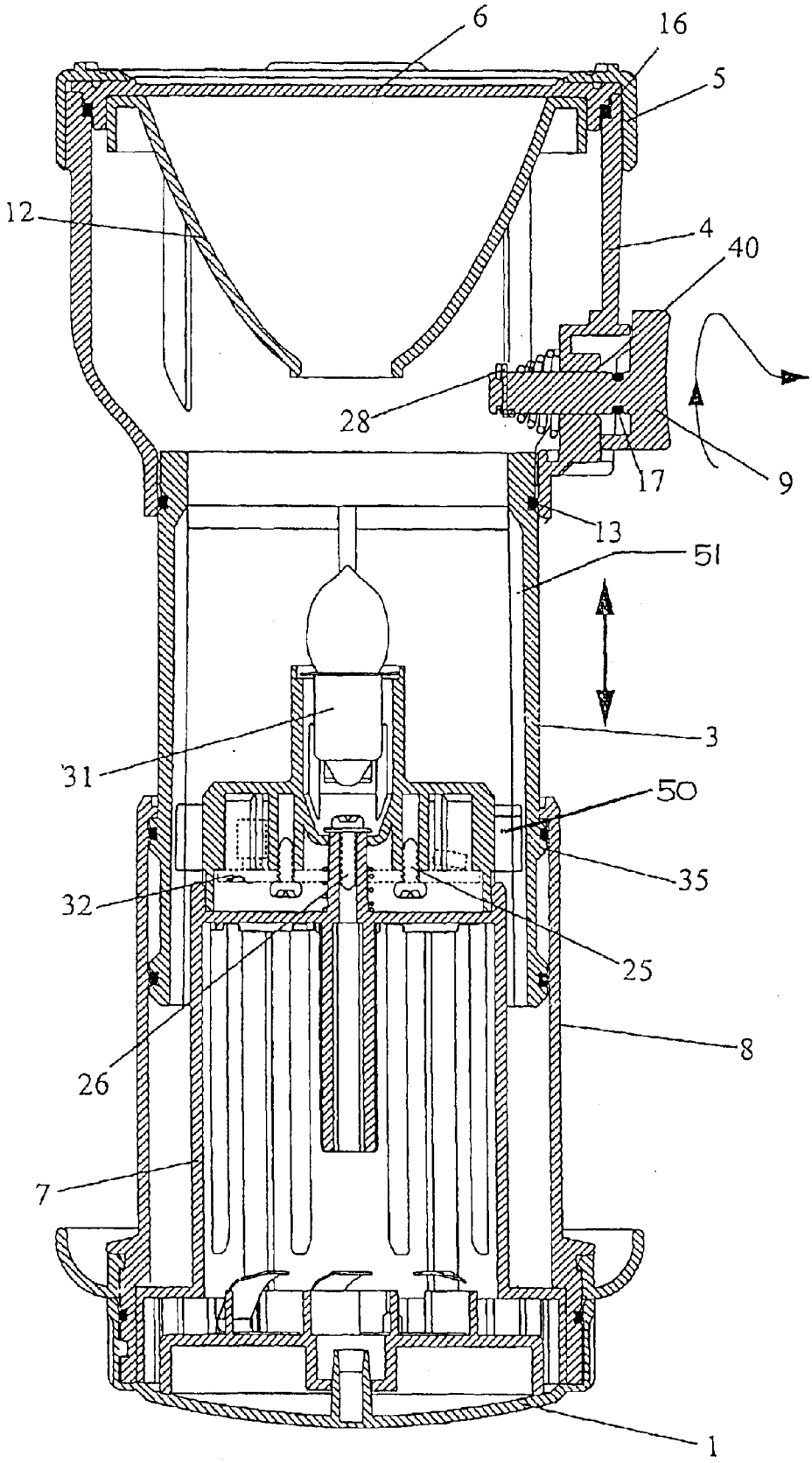
FIG. 2 is the sectional schematic diagram of the hand-held flashlight shown in FIG. 1 in extension condition.
Figure 3:
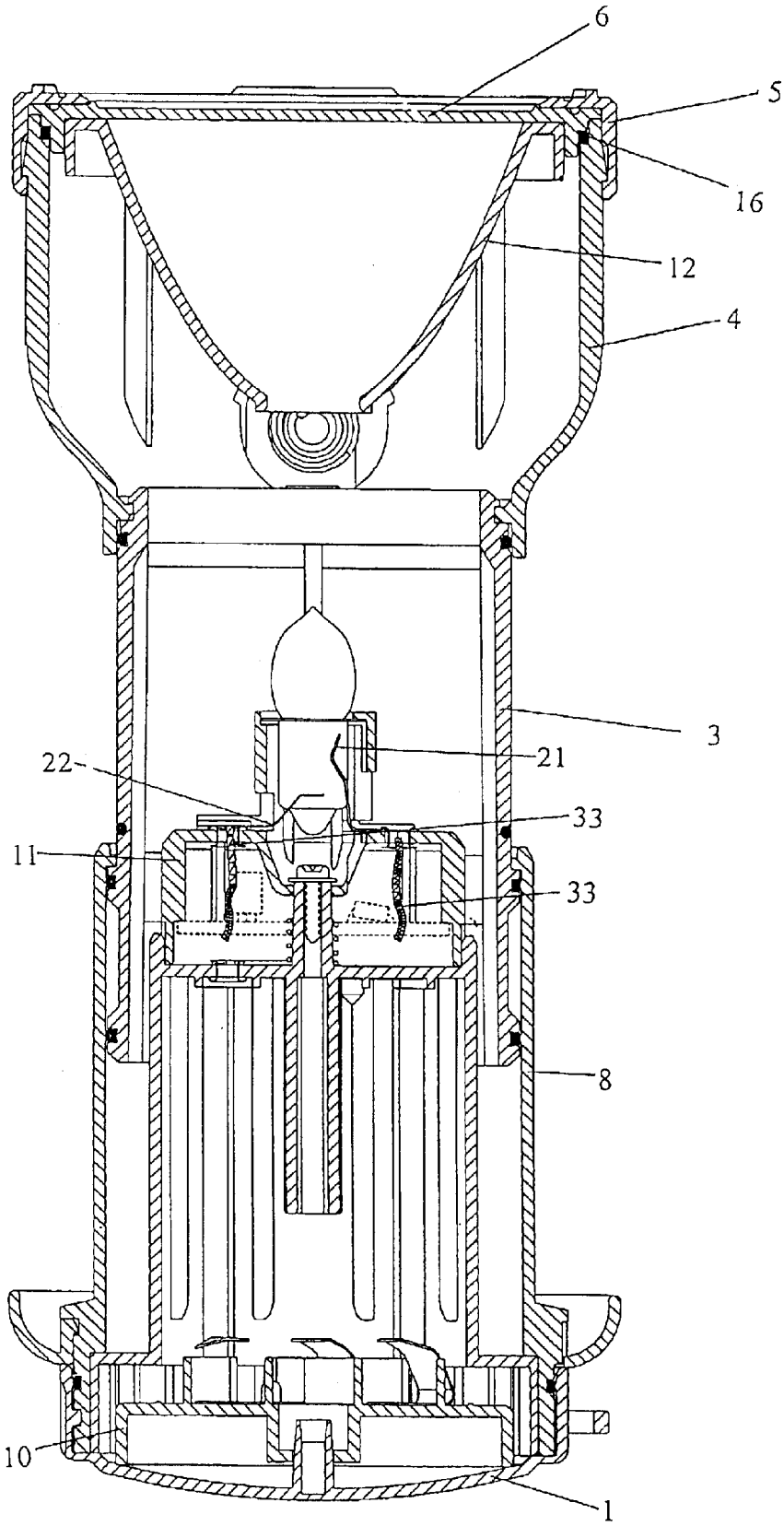
FIG. 3 is the sectional schematic diagram of the hand-held flashlight shown in FIG. 2 in another direction.
Figure 4:
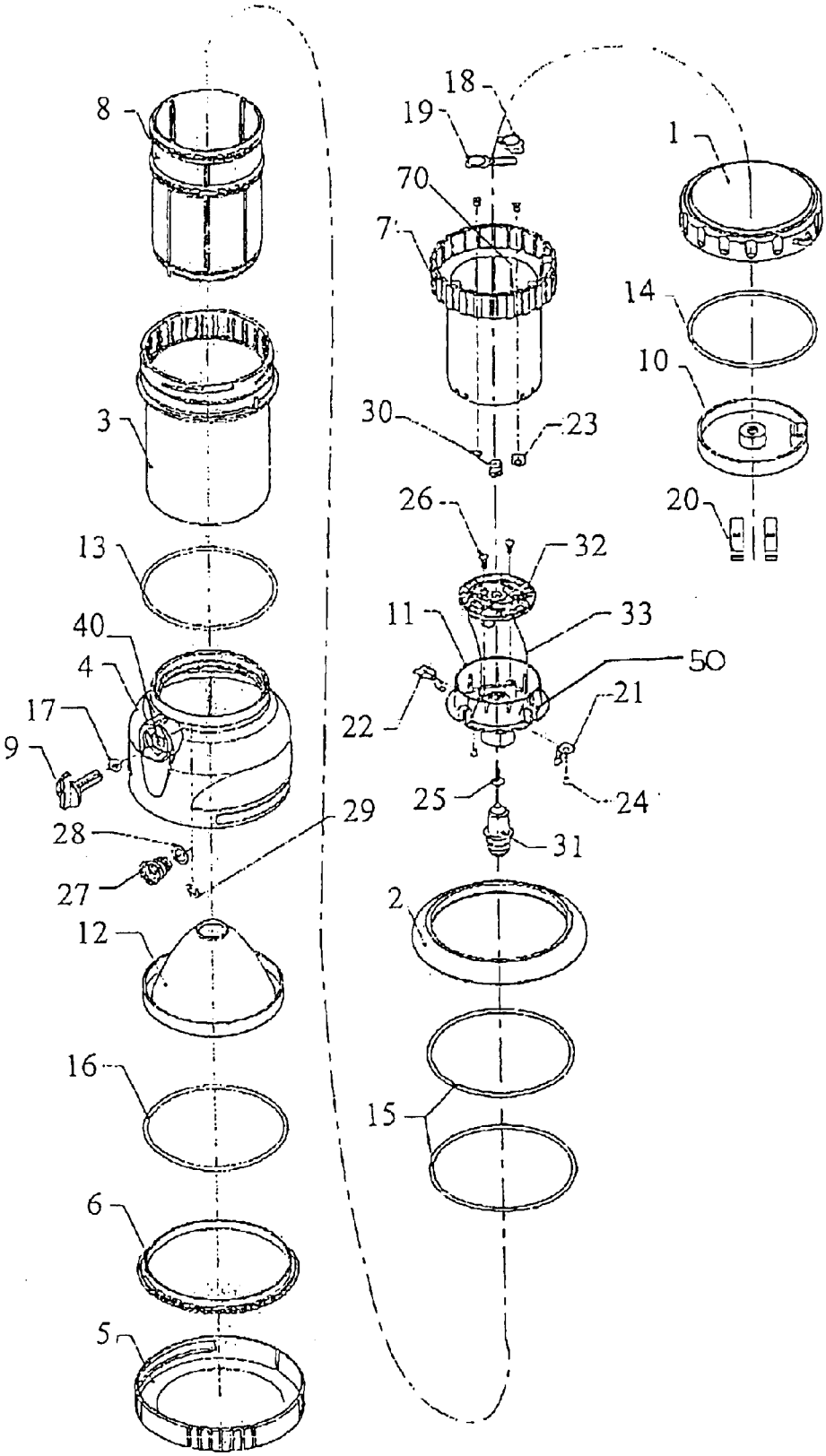
FIG. 4 is the stereoscopic disassembly diagram of the hand-held flashlight shown in FIG. 2.

As shown in FIGS. 1–4, an embodiment of the invention is a hand-held flashlight applicable for illumination of long distance and 360-degree sector illumination consisting of among other things a head, a body, a bottom cap and an exhaust unit. The head comprising a head-case 4, reflecting cup 12, transparent cover 6, transparent cylinder 3, two O-rings 16 and 13, and outer cap 5. The head of the flashlight adapts outer cap 5 to fix reflecting cup 12 and transparent cover 6 onto the front end of head-case 4, and O-ring 16 is provided between head-case 4 and transparent cover 6 for sealing.

In an embodiment of the invention the rear end of head-case 4 bayonet-joints with transparent cylinder 3, and another O-ring 13 is fitted between transparent cylinder 3 and head-case 4 for sealing. There are two lugs 35 on lower outer surface of transparent cylinder 3 used for clamping onto body-case 8, and groove 36 is provided inside lugs 35 to hold O-ring 15.

In an embodiment of the invention there may be a through hole 40 in the side of head-case 4, with an exhaust unit is fitted inside said through hole 40. The exhaust unit comprising an air permeation knob 9 that fits inside through hole 40 and penetrates it, cone spring 27, copper pad 28 and E-shaped pad 29. A rubber ring 17 for sealing is provided between permeation knob 9 and the inner wall of through hole 40. When permeation knob 9 screws out, air can go in or out of the head-case 4 to supplement or relief air pressure required for stretching or compressing the transparent cylinder 3. Conversely, when pressing down permeation knob 9, through hole 40 is sealed to prevent air or water from entering the flashlight, which makes underwater use possible.

The body of flashlight includes body-case 8 that telescopes onto the outer case of transparent cylinder 3. Said body-case 8 has collar flange 80 in its upper inside surface. The telescoping of the transparent cylinder occurs along a concentric axis of the flashlight body. Said collar flange 80 is used to clamp lug 35 of transparent cylinder 3 to prevent transparent cylinder 3 from being drawn out of body-case 8. Inside the transparent cylinder 3, there is a cell holder 7 that forms cell chamber 70 inside it for containing four cells. Lamp cartridge 11, used for fixing lamp 31, is fitted by virtue of screws 25 on the top of cell holder 7. The outer collar of lamp cartridge 11 may have a plurality of lugs 50 which may engage with the lock grooves or lugs 51 inside transparent cylinder 3, so that lamp cartridge 11 is driven by transparent cylinder 3 to rotate together. Print circuit board (PCB) 32 is installed inside lamp cartridge 11 by screws 26. Through wire 33, said circuit board 32 is connected respectively with lamp positive piece 22 and lamp negative piece 21 that are fixed in the lamp cartridge 11. And, said lamp positive piece 22 and negative piece 21 are electrically connected to lamp 31. Meanwhile, print circuit board 32 is electrically connected with cells in cell chamber 70 through switching piece 23 fitted on the top of cell holder 7. As four cells are installed in cell chamber 70, for their connection there are source negative piece 18, source link piece 19 and copper piece 20 in turnplate 10 inside bottom cap 1. Besides, O-ring 14 is fitted between bottom cap 1 and turnplate 10 for sealing to prevent water leakage.

Figure 9:
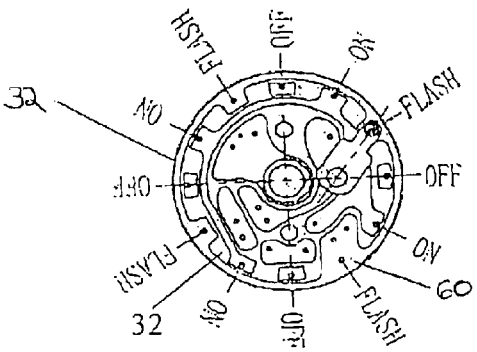
FIG. 9 is the schematic diagram of ON, FLASH and OFF contact allocation in the circuit board.

As shown in FIG. 9, the hand-held flashlight in accordance with the present utility model is equipped with multiple contacts 60 in print circuit board 32 for various operation modes, names, ON, FLASH and OFF mode, which are distributed in sequence in a circle at an equal angle. As a result, when the body and the head are relatively rotated, it brings switching piece 23 into touch with different contacts in print circuit board 32, which bring about various modes, such as ON, FLASH and OFF to meet the demands of different users in various conditions. For example, FLASH mode gives out signal for outside help.

When using the hand-held flashlight of this utility model, it is required only to turn the body or the head of the flashlight at willing, so that the transparent cylinder 3 brings along lamp cartridge 11 to rotate. By this way, lamp 31 will be in ON, FLASH or OFF mode, and users can select different mode according to their demand. If the flashlight is required to provide illumination of 360-degree sector, the user can pull out permeation knob 29 so that the inside air of flashlight is communicated with ambient air. After that, stretch out the head of the flashlight, then the beam of lamp 31 penetrates transparent cylinder 3 and shines out, which provides illumination of 360-degree sector. At this time, it is required only to turn the body of the flashlight or the head to select ON, FLASH or OFF mode. If pressing down permeation knob 29, it will be in sealing conditions, which can reach the objective of under water usage. To restore the original status, pull out permeation knob 29 again so that the inside air of flashlight connects with ambient air, then push back the head of the flashlight, and finally press down the permeation knob.

Figure 5:
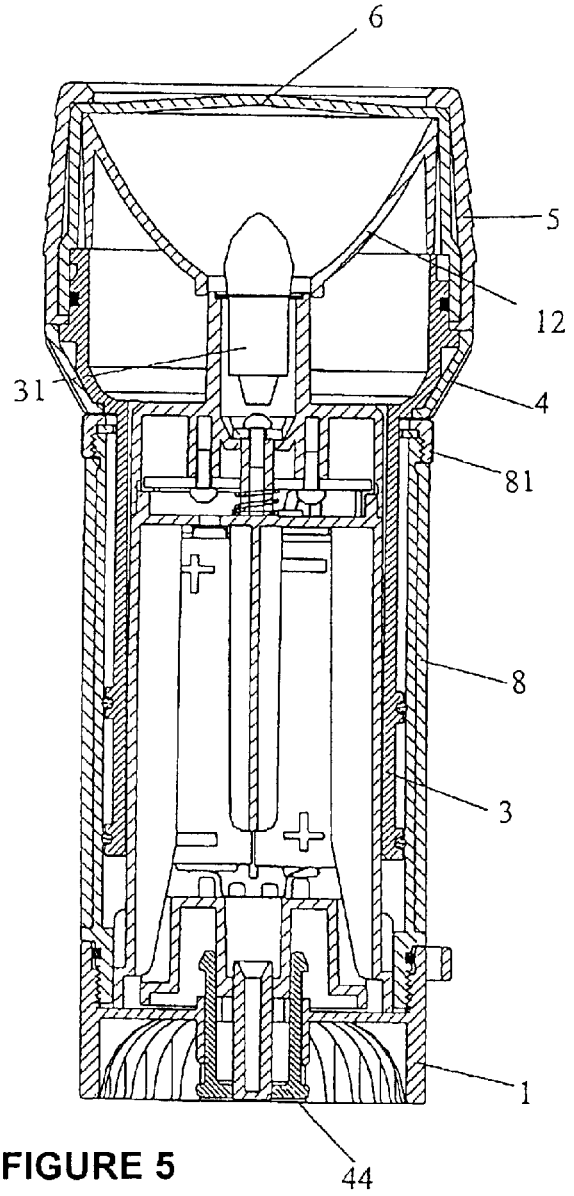
FIG. 5 is the sectional schematic diagram of the hand-held flashlight in accordance with the present invention.
Figure 6:
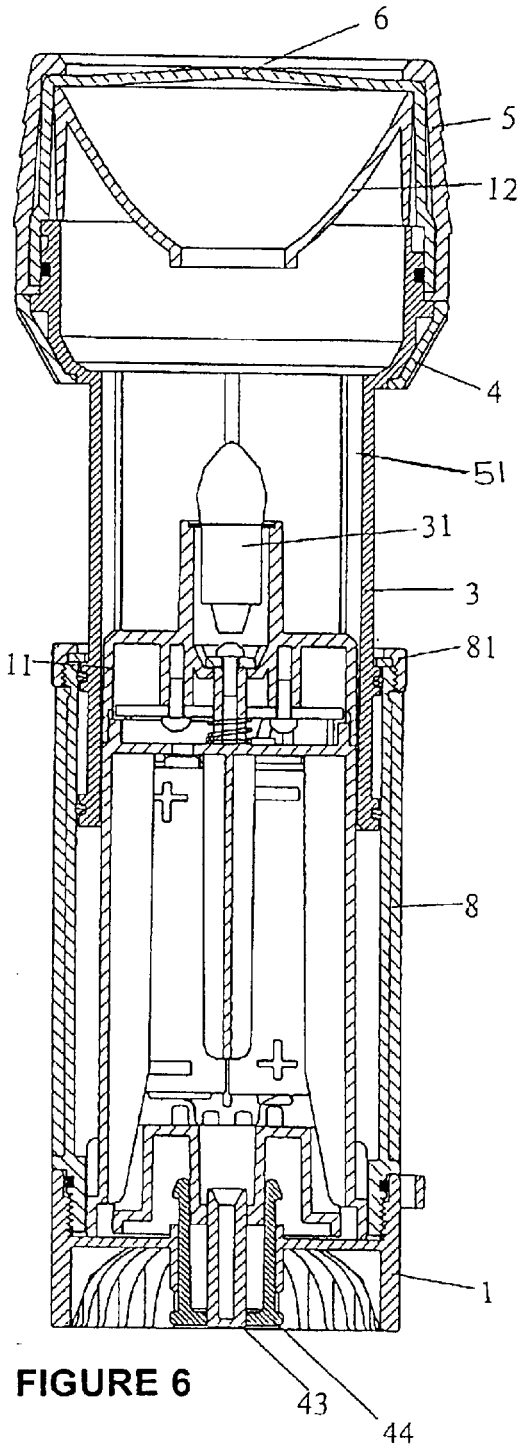
FIG. 6 is the sectional schematic diagram of the hand-held flashlight shown in FIG. 5 in extension condition.
Figure 7:
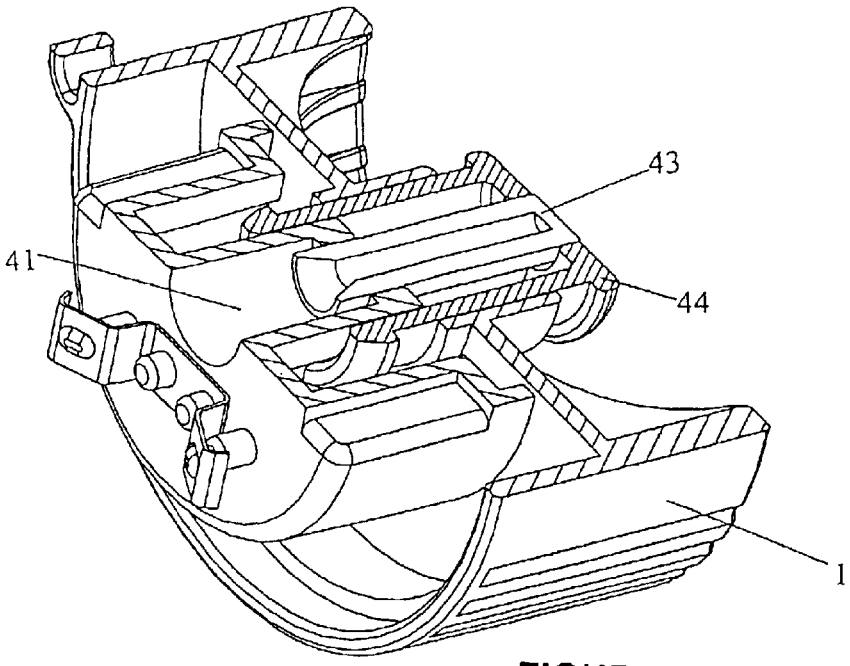
FIG. 7 is the stereoscopic sectional diagram of the bottom cap of hand-held flashlight shown in FIG. 5.
Figure 8:
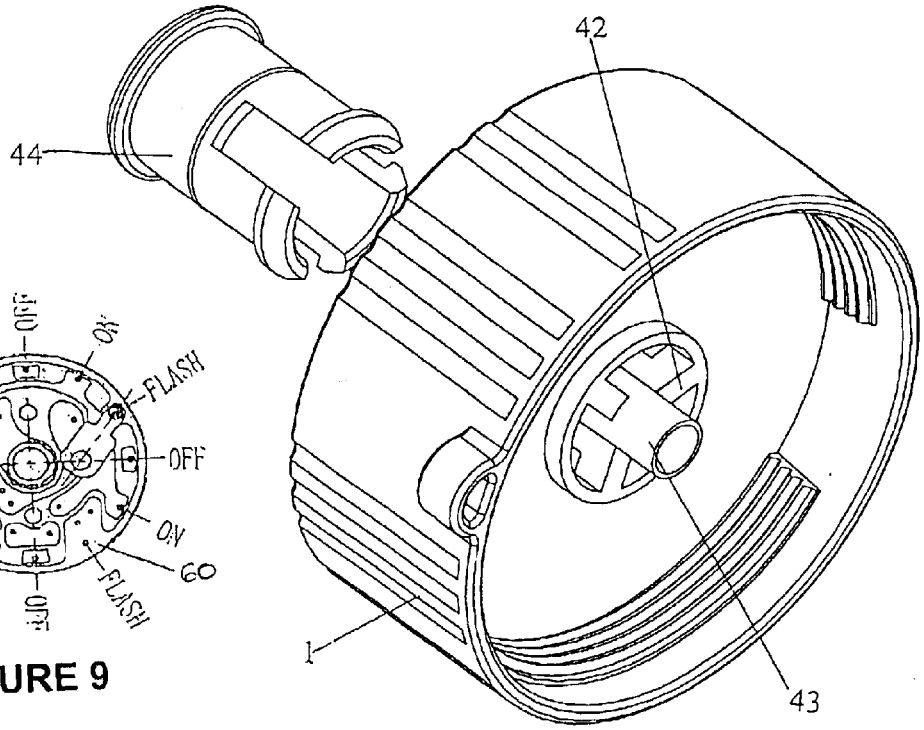
FIG. 8 is the stereoscopic schematic diagram of bottom cap shown in FIG. 7 when the attached piece of bottom cap is detached from it.

As shown in FIG. 5 and FIG. 6, the exhaust unit can be also arranged in bottom cap 1. It means that there is through hole 41 in the middle of bottom cap 1. Plug 43 fits into the center of said through hole 41 through rib plate 42, and a moveable attachment 44 is installed between plug 43 and the wall of through hole 41, as shown in FIG. 7 and FIG. 8. If attachment 44 is pull out, the outside air enters the flashlight in virtue of through hole 41. And when attachment 44 is pressed down, the flashlight is sealed to prevent air or water leakage so that the flashlight can be used under water.

Furthermore, body-case 8 can be made up of two layers, namely, inside and outside layer. And collar flange 80 on the top of body-case 8 can be replaced with attachment 81 shown in FIG. 5 and FIG. 6 to reach the purpose of engagement and fixing with transparent cylinder 3.

In summary, the hand-held flashlight in accordance with the present utility model not only possesses the function of existing hand-held flashlight for illumination of long distance focusing, but also provides illumination of 360-degree sector by stretching out the head of the flashlight. As a result, the shortcoming of existing hand-held flashlight is overcome, which only provides one way illumination that brings about lack of illumination of large rest area. In addition, the hand-held flashlight of this utility model provides quite a few different lighting modes to meet various demands of users, such as ask for help.

Moreover, the above gives detailed description only for two practical examples in accordance with the present utility model, which does not cover all the protection scope of the present utility model. For engineering personnel in this technical field, it is fairly easy to make simple changes and modifications. But these changes and modifications cannot disgress from the design idea of the present utility model. For these reasons, any equivalent change or modification made according to the design idea of this utility model is considered to violate the protection scope of the present utility model.

What is claimed is:

1. A hand-held flashlight comprising:

a head having a head-case with a rear end, a transparent cover, and a reflecting cup;

a transparent cylinder fitted to the rear end of the head, the transparent cylinder having a plurality of lugs on a transparent cylinder inner wall;

a body having a body-case wherein said body-case is in concentric axial sliding cooperation with the transparent cylinder;

a cell holder inside the body-case for containing and retaining cells;

a lamp cartridge having a plurality of lugs on an outer cartridge wall for securing a lamp, said lamp cartridge being located above the cell holder, said lugs on the outer cartridge wall and said transparent cylinder inner wall cooperating for rotation of the transparent cylinder and lamp cartridge;

an electrical connection means to provide electrical communication between the lamp and the cells, said means further having an on-off means;

a bottom cap engageable with the body-case and having electrical contact surfaces for contact with the cells.

2. The flashlight of claim 1, further having an exhaust unit in communication with an interior of the flashlight, for regulation of air pressure in the interior of the flashlight.

3. The flashlight of claim 1, wherein the electrical connection means is a circuit board having a plurality of contacts, the contacts being in electrical communication with electrical circuits.

4. The flashlight of claim 3, wherein the contacts are in electrical connection with an ON circuit, a FLASH circuit, and an OFF circuit.

5. The flashlight of claim 3, wherein the plurality of contacts are disposed in a circular arrangement around the circuit board.

6. The flashlight of claim 1, wherein the concentric axial sliding cooperation allows the flashlight to move between a focused illumination configuration and a lateral dispersed illumination configuration.

7. A hand-held flashlight comprising: a head having a head-case with a rear end, a transparent cover, and a reflecting cup;

a transparent cylinder fitted to the rear end of the head;

a body having a body-case wherein said body-case is in concentric axial sliding cooperation with the transparent cylinder;

a cell holder inside the body-case for containing and retaining cells;

a lamp cartridge for securing a lamp, said lamp cartridge being located above the cell holder;

an electrical connection means to provide electrical communication between the lamp and the cells, said means further having an on-off means;

a bottom cap engageable with the body-case and having electrical contact surfaces for contact with the cells; and an exhaust unit fixed to the head-case, said exhaust unit comprising:

a knob moveably fitted inside a head-case through-hole;

a cone spring fitted over a portion of the knob;

a copper pad disposed on an end of the cone spring;

an E-shaped pad in contact with the copper pad for a retention of the cone spring;

a rubber-sealing ring disposed on a portion of the knob for sealing between the through-hole and the knob.

8. A hand-held flashlight comprising:

a head having a head-case with a rear end, a transparent cover, and a reflecting cup;

a transparent cylinder fitted to the rear end of the head;

a body having a body-case wherein said body-case is in concentric axial sliding cooperation with the transparent cylinder;

a cell holder inside the body-case for containing and retaining cells;

a lamp cartridge for securing a lamp, said lamp cartridge being located above the cell holder;

an electrical connection means to provide electrical communication between the lamp and the cells, said means further having an on-off means;

a bottom cap engageable with the body-case and having electrical contact surfaces for contact with the cells; and an exhaust unit in communication with an interior of the flashlight, for regulation of air pressure in the interior of the flashlight; wherein the exhaust unit is fixed to the bottom cap, said exhaust unit comprising;

an attachment moveably cooperating with a bottom cap through hole;

a button cap through hole;

a plug fit into the attachment and into a rib plate; and a sealing ring between the attachment and the through hole.

9. A hand-held flashlight wherein the flashlight is made fluid tight, said flashlight comprising:

a head having a head-case with a rear end, a transparent cover, and a reflecting cup;

a transparent cylinder fitted to the rear end of the head;

a transparent cylinder O-ring disposed between the transparent cylinder and body-case;

a body having a body-case wherein said body-case is in concentric axial sliding cooperation with the transparent cylinder;

a cell holder inside the body-case for containing and retaining cells;

a lamp cartridge for securing a lamp, said lamp cartridge being located above the cell holder;

an electrical connection means to provide electrical communication between the lamp and the cells, said means further having an on-off means;

a bottom cap engageable with the body-case, and having electrical contact surfaces for contact with the cells;

a bottom cap O-ring disposed between the bottom cap and the body-case; and a transparent cover O-ring disposed between the transparent cover and the head-case.

* * * * *